US009708995B2

(12) United States Patent
Yoshikawa

(10) Patent No.: US 9,708,995 B2
(45) Date of Patent: Jul. 18, 2017

(54) CONTROL DEVICE FOR INTERNAL COMBUSTION ENGINE

(75) Inventor: Shunichi Yoshikawa, Ebina (JP)

(73) Assignee: NISSAN MOTOR CO., LTD., Yokohama-Shi (JP)

( * ) Notice: Subject to any disclaimer, the term of this patent is extended or adjusted under 35 U.S.C. 154(b) by 390 days.

(21) Appl. No.: 13/820,649

(22) PCT Filed: Dec. 27, 2011

(86) PCT No.: PCT/JP2011/080170
§ 371 (c)(1),
(2), (4) Date: Mar. 4, 2013

(87) PCT Pub. No.: WO2012/090988
PCT Pub. Date: Jul. 5, 2012

(65) Prior Publication Data

US 2013/0166180 A1 Jun. 27, 2013

(30) Foreign Application Priority Data

Dec. 27, 2010 (JP) ..... 2010-290239

(51) Int. Cl.
*F02D 41/18* (2006.01)
*F02D 41/30* (2006.01)
*F02D 41/06* (2006.01)

(52) U.S. Cl.
CPC ..... *F02D 41/18* (2013.01); *F02D 41/062* (2013.01); *F02D 41/182* (2013.01); *F02D 41/30* (2013.01); *F02D 2200/0406* (2013.01)

(58) Field of Classification Search
CPC .... F02D 41/18–41/187; F02D 2200/04; F02D 41/062; F02D 41/30; F02M 35/1038; F02M 35/10386; F02M 69/467; F02M 69/48
USPC ..... 123/389, 436; 701/102, 103, 104, 110, 701/113; 73/114.32, 114.33, 114.37
See application file for complete search history.

(56) References Cited

U.S. PATENT DOCUMENTS 3,931,808 A * 1/1976 Rachel ..... F02D 41/068 123/179.17
4,155,332 A * 5/1979 Yaegashi ..... F02D 41/26 123/478
4,336,782 A * 6/1982 Endo ..... F02D 41/185 123/478

(Continued)

FOREIGN PATENT DOCUMENTS

JP 01-092542 A 4/1989
JP 07-063101 A 3/1995

(Continued)

*Primary Examiner* — Sizo Vilakazi
*Assistant Examiner* — Brian Kirby
(74) *Attorney, Agent, or Firm* — Foley & Lardner LLP

(57) ABSTRACT

A control device for an internal combustion engine provided with an intake air pressure sensor and an airflow meter includes a calculation unit for calculating a fuel injection quantity on the basis of a negative pressure of intake air measured by the intake air pressure sensor when a cranking motor starts cranking the internal combustion engine, and a switching unit for switching to calculation of the fuel injection quantity on the basis of an intake air flow rate measured by the airflow meter when a change value in an actual intake air quantity becomes smaller than a reference value.

6 Claims, 4 Drawing Sheets

(56) References Cited

U.S. PATENT DOCUMENTS 4,368,712 A * 1/1983 Jackson ..... F02D 41/0042 123/522
4,513,706 A * 4/1985 Atzet ..... F02M 7/17 123/198 D
4,599,694 A * 7/1986 Aposchanski ..... F02D 41/18 700/282
4,644,474 A * 2/1987 Aposchanski ..... F02D 41/263 123/494
4,664,090 A * 5/1987 Kabasin ..... F02D 41/2422 123/478
4,735,181 A * 4/1988 Kaneko ..... F02D 11/105 123/361
4,736,725 A * 4/1988 Iwaki ..... F02D 41/18 123/480
4,773,375 A * 9/1988 Okino ..... F02D 41/04 123/488
4,875,456 A * 10/1989 Tomisawa ..... F02D 31/005 123/339.15
4,893,526 A * 1/1990 Tokoro ..... B60W 10/06 477/43
4,951,209 A * 8/1990 Nagaishi ..... F02D 35/003 123/492
4,951,499 A * 8/1990 Akimoto ..... F02D 41/182 73/114.32
5,008,824 A * 4/1991 Clark ..... F02D 41/18 701/103
5,255,655 A * 10/1993 Denz ..... F02D 41/045 123/479
5,423,208 A * 6/1995 Dudek ..... F02D 41/045 123/478
5,577,474 A * 11/1996 Livshiz ..... F02D 31/002 123/352
5,687,694 A * 11/1997 Kanno ..... F02B 61/045 123/478
6,308,683 B1 * 10/2001 Pursifull ..... F02D 41/18 123/399
6,671,613 B2 * 12/2003 Stotsky ..... F02D 41/1401 123/480
6,748,313 B2 * 6/2004 Li ..... F02D 41/18 701/102
6,789,414 B2 * 9/2004 Fuwa ..... F02D 41/18 123/488
6,868,327 B2 * 3/2005 Muto ..... F02D 41/18 123/382
7,319,929 B1 * 1/2008 Davis ..... F02D 41/18 123/361
7,448,369 B2 * 11/2008 Robinson ..... F02D 41/18 123/681
2002/0107630 A1 * 8/2002 Yagi ..... F02D 41/1401 701/102
2004/0007211 A1 * 1/2004 Kobayashi ..... F02D 41/1401 123/472
2004/0060540 A1 * 4/2004 Fuwa ..... F02D 13/0253 123/346
2008/0060619 A1 * 3/2008 Allston ..... F02M 1/165 123/549
2010/0126260 A1 * 5/2010 Bowling ..... G01M 15/09 73/114.37
2010/0274464 A1 * 10/2010 Ramappan ..... F02D 37/02 701/103

FOREIGN PATENT DOCUMENTS

JP 07-243344 A 9/1995
JP 08-144834 A 6/1996
JP 2003193888 A * 7/2003
JP 3586975 B2 8/2004
JP 2010-209840 A 9/2010
JP 2010209840 A * 9/2010 ..... F02D 41/04

* cited by examiner

CONTROL DEVICE FOR INTERNAL COMBUSTION ENGINE

TECHNICAL FIELD

The present disclosure relates to a control device for an internal combustion engine.

BACKGROUND ART

JP-3586975-B discloses a technique for closing an intake throttle during cranking to develop a negative pressure on a downstream side along an intake air flow direction of the intake throttle.

SUMMARY

Generally, the flow rate of intake air is conventionally detected on the basis of a signal from a hot-wire airflow meter and the fuel quantity to be injected is determined on the basis of the intake air flow rate (L-Jetronic system).

Having capability of quick response, the L-Jetronic system serves to improve fuel economy and stabilize combustion during steady-state running conditions. When the intake air flow rate is low, however, the intake air quantity obtained by the L-Jetronic system does not remain stable and the fuel injection quantity becomes unstable.

The present disclosure has been made in light of the aforementioned problem of the related art. Accordingly, it is an object of the disclosure to provide a control device for an internal combustion engine that can inject fuel in a stable fashion even when the intake air flow rate is low, such as during cranking, and can switch the accuracy of intake air flow rate detection under conditions where the accuracy is high.

A control device for an internal combustion engine in one embodiment of the present invention is provided with an intake air pressure sensor and an airflow meter. The control device includes a calculation unit for calculating a fuel injection quantity on the basis of a negative pressure of intake air measured by the intake air pressure sensor when a cranking motor starts cranking the internal combustion engine, and a switching unit for switching the calculation unit so as to calculate the fuel injection quantity on the basis of an intake air flow rate measured by the airflow meter when the change value in an actual intake air quantity becomes smaller than a reference value.

An embodiment and advantages of the present invention will be described in detail hereinbelow in conjunction with the accompanying drawings.

EMBODIMENT

Figure 1:
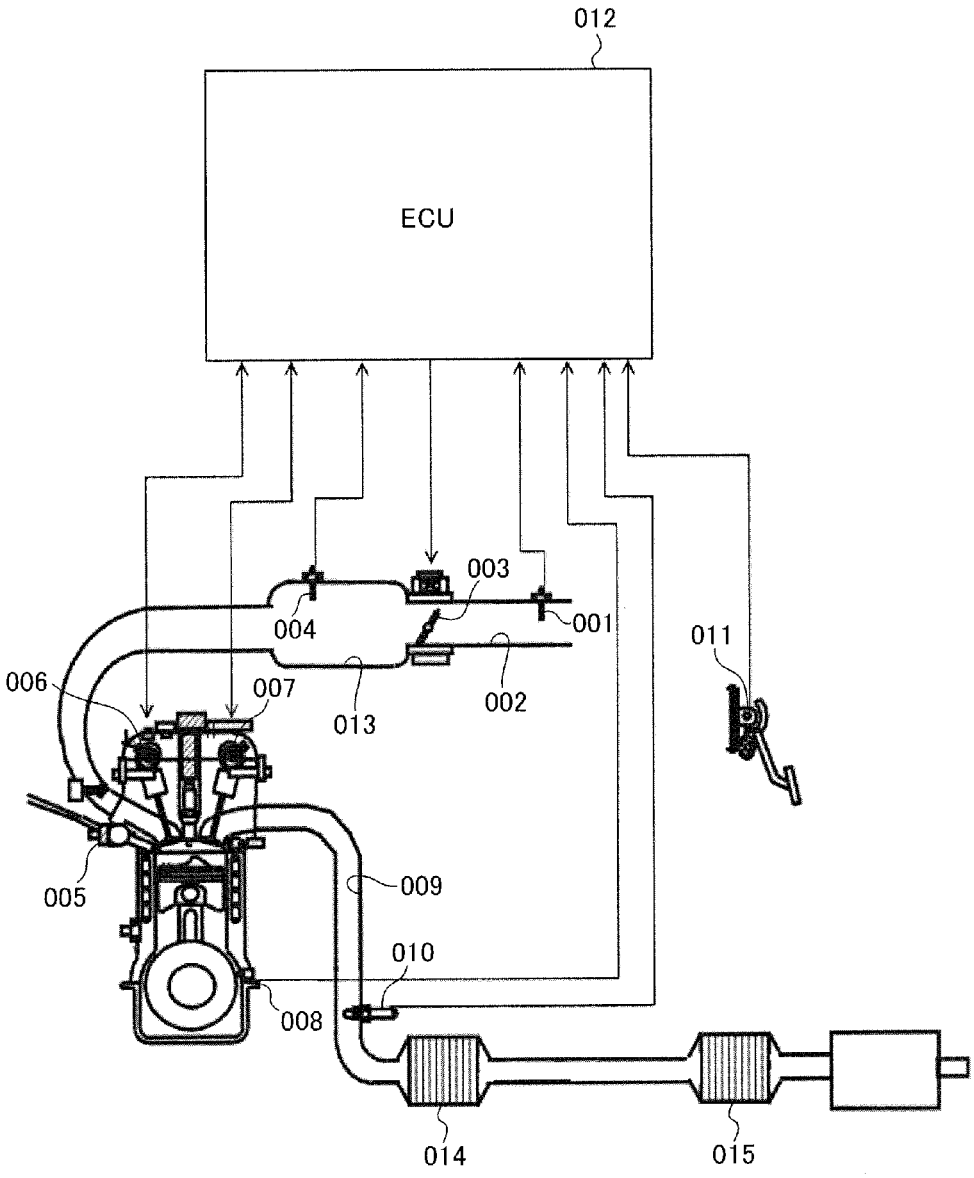
FIG. 1 is a diagram depicting a configuration for explaining an embodiment of a control device for an internal combustion engine according to the invention.

A basic concept of the present invention is described at first.

An embodiment of the present invention is directed toward the problem that, when the flow rate of intake air is low, such as during cranking, the fuel injection quantity becomes unstable owing to a reduction in the accuracy of detecting the intake air quantity in an L-Jetronic system. What is important herein is that a so-called D-Jetronic system is used when the intake air flow rate is low and fuel injection is switched to the L-Jetronic system when the intake air flow rate increases. If the D-Jetronic system is used when the intake air flow rate is low and fuel injection is switched to the L-Jetronic system in which fuel injection is controlled on the basis of detection by an airflow meter when the intake air flow rate increases, there occurs a change in conditions each time cranking is performed. This makes it impossible to set a fixed reference value for the intake air flow rate. It is also complex and difficult to set a plurality of reference values for varying operating conditions. Under such circumstances, the embodiment makes it possible to switch the accuracy of intake air flow rate detection under conditions where the accuracy is high by using a novel technique for deciding a switching timing.

To facilitate understanding of the present invention, the L-Jetronic system and D-Jetronic system are described in the beginning.

Systems for calculating the fuel quantity to be injected are broadly classified into the so-called L-Jetronic system and D-Jetronic system.

In the L-Jetronic system, basic fuel injection quantity Tp (hereinafter denoted LTp) is calculated by equation (1) below from intake air flow rate Q detected on the basis of a signal from the airflow meter disposed in an intake passage and engine speed N. Meanwhile, the flow rate of air which passes along a wire of the airflow meter is referred to as the intake air flow rate. Basically, when an engine is started, an actual value of the intake air flow rate monotonically increases during an initial stage of cranking. The unit of the intake air flow rate is "g/s".

$$LTp=K\times Q/N \text{ (where } K \text{ is a constant)} \quad (1)$$

In the D-Jetronic system, basic fuel injection quantity Tp (hereinafter denoted DTp) is calculated by equation (2) below from intake air pressure P detected by a pressure sensor disposed in the intake passage downstream of a throttle valve. Meanwhile, the air quantity introduced into a cylinder per cycle calculated from the intake air pressure is referred to as the cylinder intake air quantity. Basically, when the engine is started, an actual value of the cylinder intake air quantity monotonically decreases during the initial stage of cranking. The unit of the cylinder intake air quantity is "g/cyl."

$$DTp=Kc\times P\times \eta V\times KTA \quad (2)$$

(where Kc is a constant,

ηV is charging efficiency and

KTA is an int ake air temperature correction coefficient.

Fuel injection quantity Ti is finally calculated by equation (3) below on the basis of the aforementioned basic fuel injection quantity Tp (LTp or DTp):

$$Ti=Tp\times COEF \quad (3)$$

(where COEF denotes various kind of correction coefficients)

While the L-Jetronic system is superior to the D-Jetronic system in various points, the accuracy of intake air flow rate detection decreases if a hot-wire airflow meter is used when the intake air quantity is extremely low during such an event as cranking. Therefore, the fuel injection quantity determined from the intake air flow rate obtained by the hot-wire airflow meter does not correspond to an actual intake air flow rate. Meanwhile, although expressed by different units, the intake air flow rate and the cylinder intake air quantity can be converted to each other by use of a prescribed equation.

Now, the content of the embodiment of the present invention is described specifically.

FIG. 1 is a diagram depicting a configuration for explaining the embodiment of a control device for an internal combustion engine according to the invention.

The control device for an internal combustion engine of this embodiment calculates the flow rate of intake air taken into an internal combustion engine body 100 with high accuracy. In an intake passage 002 of the internal combustion engine body 100, there are provided an airflow meter 001, a throttle valve 003, an intake air pressure sensor 004 and an injector 005 in this order from an upstream side along a flow direction of air.

The airflow meter 001 is a hot-wire airflow meter. When air flows along a wire (hot wire) which is heated when conducting an electric current, the wire is deprived of heat. The higher the speed of airflow (i.e., the larger the intake air quantity introduced per unit time), the more the wire is deprived of heat. This results in a change in the resistance of the wire. The hot-wire airflow meter is a device which detects the intake air flow rate by using such property.

The throttle valve 003 of which opening is adjusted in accordance with a target output regulates the flow rate of intake air introduced into the internal combustion engine body 100. Although the target output is normally set in accordance with a signal representative of an accelerator pedal operation amount detected by an acceleration sensor 011, the target output is set independently of the sensing signal of the acceleration sensor 011 during operation by automatic cruise control, for example.

The intake air pressure sensor 004 which is provided in an intake air collector 013 detects the pressure of the intake air that flows along through the intake air collector 013. The intake air collector 013 is provided downstream of the throttle valve 003. Therefore, the pressure detected by the intake air pressure sensor 004 is equal to or lower than atmospheric pressure.

The injector 005 injects fuel. The injector 005 may be of a type which injects the fuel into an intake port or of a type which injects the fuel directly into a cylinder of the internal combustion engine body 100.

The internal combustion engine body 100 is provided with an intake valve train 006, an exhaust valve train 007 and a crank angle sensor 008.

The intake valve train 006 opens and closes the cylinder and the intake port of the internal combustion engine body 100 by means of an intake valve. The intake valve train 006 may be of a type which opens and closes the intake valve at fixed crank angles (opening/closing timings) or of a type which opens and closes the intake valve at crank angles (opening/closing timings) that are variable in accordance with operating conditions. In a case where the intake valve train 006 is of a type capable of altering the valve opening/closing timings, the intake valve train 006 is furnished with a sensor for detecting actual valve opening/closing timings as well as an actuator for altering the valve opening/closing timings. A sensing signal of this sensor is sent to an engine controller 012. Also, the actuator alters the valve opening/closing timings on the basis of a signal received from the engine controller 012.

The exhaust valve train 007 opens and closes the cylinder and an exhaust port of the internal combustion engine body 100 by means of an exhaust valve. The exhaust valve train 007 may be of a type which opens and closes the exhaust valve at fixed crank angles (opening/closing timings) or of a type which opens and closes the exhaust valve at crank angles (opening/closing timings) that are variable in accordance with the operating conditions. In a case where the exhaust valve train 007 is of a type capable of altering the valve opening/closing timings, the exhaust valve train 007 is furnished with a sensor for detecting actual valve opening/closing timings as well as an actuator for altering the valve opening/closing timings. A sensing signal of this sensor is sent to the engine controller 012. Also, the actuator alters the valve opening/closing timings on the basis of a signal received from the engine controller 012.

The crank angle sensor 008 detects the angle of rotation of a crankshaft.

In an exhaust passage 009 of the internal combustion engine body 100, there are provided an upstream exhaust emission control catalytic converter 014 and a downstream exhaust emission control catalytic converter 015 in this order from the upstream side along the flow direction of air. There is provided an A/F sensor (air-fuel ratio sensor) 010 close to an inlet of the upstream exhaust emission control catalytic converter 014. The A/F sensor (air-fuel ratio sensor) 010 detects the air-fuel ratio of exhaust gas expelled from the internal combustion engine body 100. The upstream exhaust emission control catalytic converter 014 and the downstream exhaust emission control catalytic converter 015 purify the exhaust gas expelled from the internal combustion engine body 100.

The engine controller 012 is made of a microcomputer including a central processing unit (CPU), a read-only memory (ROM), a random access memory (RAM) and an input/output (I/O) interface. The engine controller 012 may be configured with a plurality of microcomputers. The engine controller 012 receives signals from the airflow meter 001, the intake air pressure sensor 004, a sensor of the intake valve train 006, a sensor of the exhaust valve train 007, the crank angle sensor 008, the A/F sensor 010 and the acceleration sensor 011. The engine controller 012 then performs a prescribed mathematical operation on the basis of these signals and transmits control signals to the throttle valve 003, the injector 005, an actuator of the intake valve train 006 and an actuator of the exhaust valve train 007 to control operation of the internal combustion engine.

Figure 2:
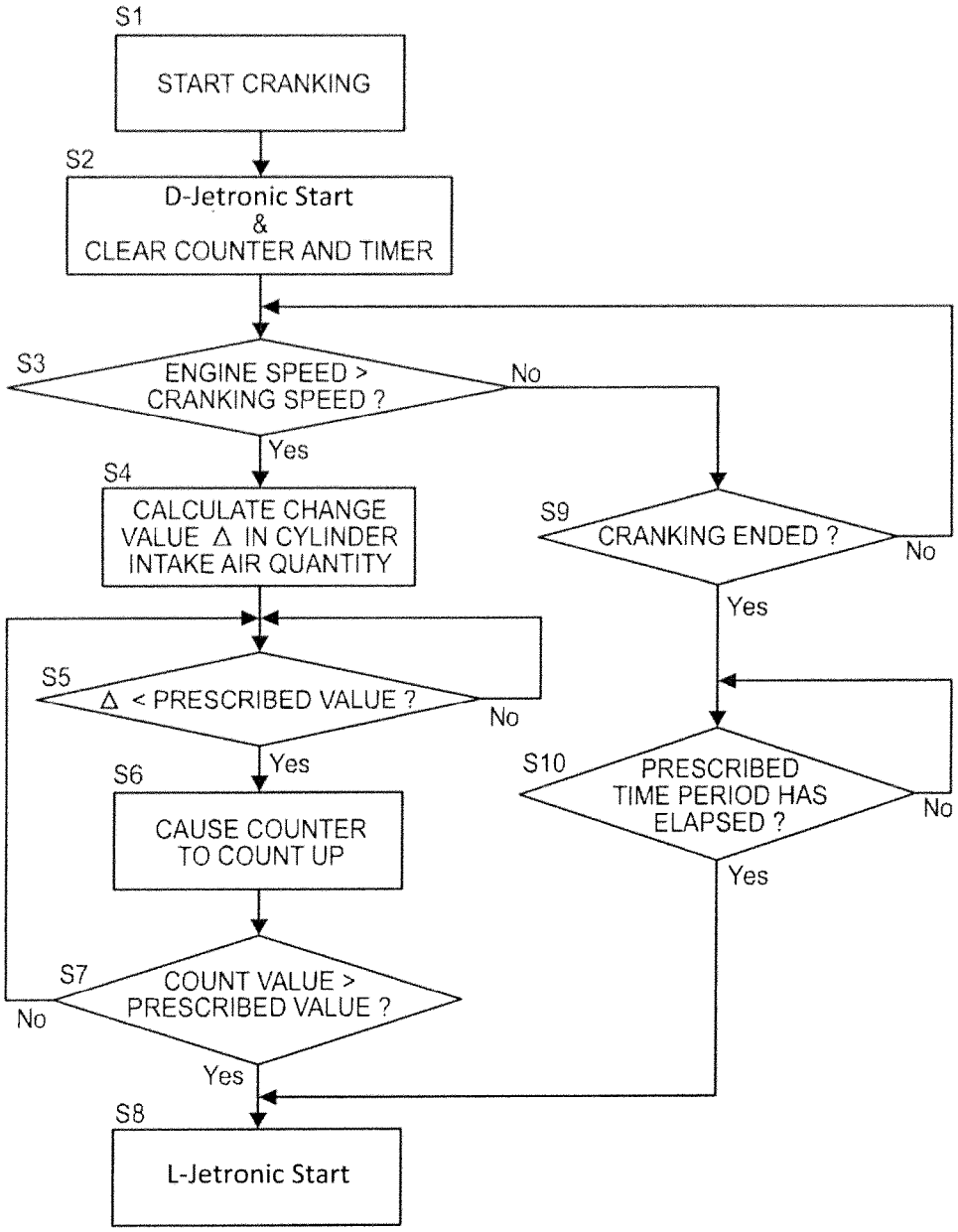
FIG. 2 is a flowchart depicting the content of specific control operation performed by an engine controller.

FIG. 2 is a flowchart depicting the content of specific control operation performed by the engine controller.

According to the embodiment, the engine controller initiates cranking in step S1. Meanwhile, in the present embodiment, the throttle valve is fully closed at the beginning of cranking in order to develop a negative pressure. Evaporation of fuel is accelerated by doing so. As a result, it is possible to improve emissions, prevent a subsequent rapid increase in engine speed (sudden acceleration) and improve fuel economy. The embodiment is based on this kind of technique.

In step S2, the engine controller initiates D-Jetronic operation and clear a counter and a timer.

In step S3, the engine controller examines whether or not the speed of the internal combustion engine is larger than cranking speed. This step determines whether or not the internal combustion engine has been brought to a state in which the internal combustion engine is not simply turned by a cranking motor while producing combustion. If the result of determination is in the affirmative, the engine controller proceeds to operation in step S4, whereas if the result of determination is in the negative, the engine controller proceeds to operation in step S9. Incidentally, it is possible to eliminate step S3 and initiate calculation of a change value in the cylinder intake air quantity immediately after the beginning of cranking. In other words, it is possible to cause the engine controller to always calculate the change value in the cylinder intake air quantity at engine startup.

In step S4, the engine controller calculates the change value Δ in the cylinder intake air quantity. Specifically, the engine controller calculates the change value Δ in the cylinder intake air quantity by determining the absolute value of a value obtained by subtracting the value of the cylinder intake air quantity in an immediately preceding cycle from the value of the cylinder intake air quantity in a current cycle. As mentioned earlier, the actual value of the cylinder intake air quantity monotonically decreases when the internal combustion engine is just started and, therefore, the change value Δ in the cylinder intake air quantity is a negative value immediately after engine startup and has a large absolute value in the beginning. Then, the absolute value becomes smaller with the lapse of time and converges to zero in a steady-state condition. In this embodiment, the cylinder intake air quantity is estimated on the basis of the intake air pressure P detected by the intake air pressure sensor 004. This serves to prevent a reduction in the accuracy of intake air flow rate detection which may potentially occur as a result of using the airflow meter when the intake air flow rate is low.

In step S5, the engine controller stays standby until the aforementioned change value Δ becomes smaller than a prescribed value (reference value), and when the change value Δ becomes smaller than the prescribed value (reference value), the engine controller proceeds to operation in step S6. This prescribed value (reference value) is an optimum value which is obtained in advance by an experiment in accordance with specifications of the internal combustion engine, the optimum value being suited for switching the control operation on the basis of the change value Δ in the cylinder intake air quantity. Specifically, the prescribed value (reference value) is a reference value which makes it possible to detect a situation where the intake air flow rate has sufficiently increased and stabilized with high accuracy and then switch from calculation of the fuel injection quantity based on the negative pressure of the intake air to calculation of the fuel injection quantity based on the intake air flow rate. This will be later described in further detail.

In step S6, the engine controller causes the counter to count up.

In step S7, the engine controller determines whether or not the count value of the counter has become larger than the prescribed value (reference value). If the result of determination is in the negative, the engine controller proceeds to operation in step S5, whereas if the result of determination is in the affirmative, the engine controller proceeds to operation in step S8.

Incidentally, if a prescribed value (reference value) of the count value of the counter is set to an extremely small value, the engine controller instantly switches to L-Jetronic system when the change value Δ in the cylinder intake air quantity becomes larger than the prescribed value (reference value).

Also, if the prescribed value (reference value) of the count value of the counter is set to a value which is large to a certain extent, the engine controller switches to the L-Jetronic system when a situation where the change value Δ in the cylinder intake air quantity is smaller than the prescribed value (reference value) continues to exist for a prescribed time period. In the initial stage of cranking after the beginning thereof, there exists a situation where particularly significant variations occur in the intake air flow rate (cylinder intake air quantity). Thus, there is a possibility that the intake air flow rate may not be sufficiently stabilized even if the change value Δ in the cylinder intake air quantity once becomes smaller than the prescribed value (reference value). Nevertheless, if the prescribed value (reference value) of the count value of the counter is set to a value which is large to a certain extent, the engine controller switches to the L-Jetronic system when the situation where the change value Δ in the cylinder intake air quantity is smaller than the prescribed value (reference value) continues to exist for the prescribed time period. This makes it possible to detect that the intake air flow rate has sufficiently increased with high accuracy.

In step S8, the engine controller initiates the L-Jetronic system upon switching the internal combustion engine from the D-Jetronic system.

In step S9, the engine controller determines whether or not a cranking process has ended. If the result of determination is in negative, the engine controller proceeds to operation in step S3, whereas if the result of determination is in the affirmative, the engine controller proceeds to operation in step S10.

In step S10, the engine controller stays standby until a time count of the timer reaches a prescribed time period. If the prescribed time period has elapsed, the engine controller proceeds to operation in step S8.

Figure 3:
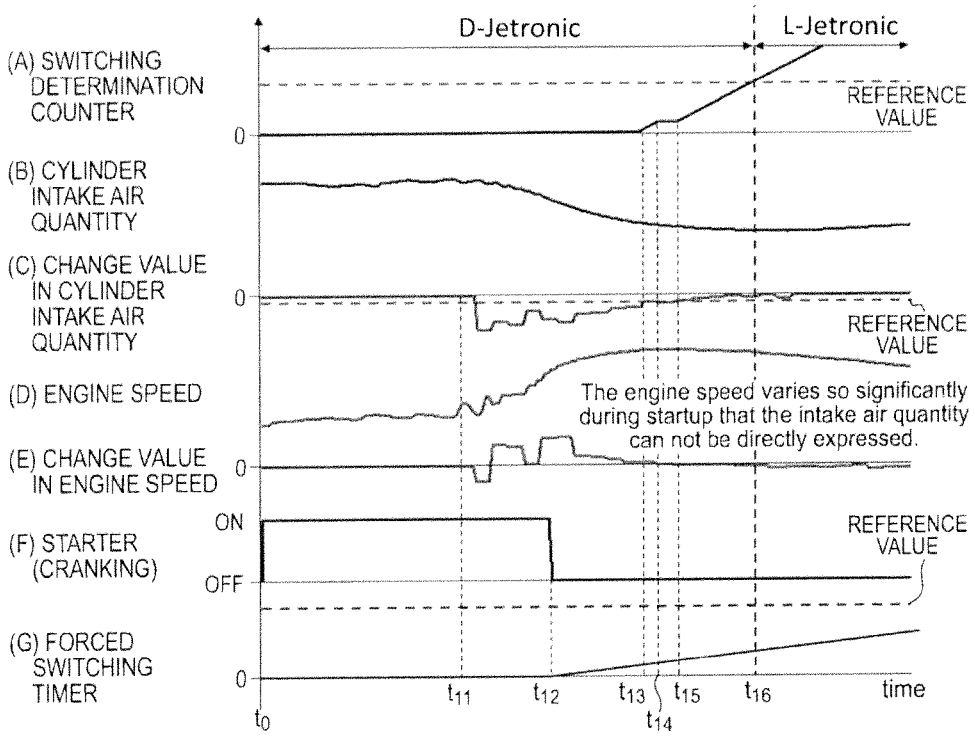
FIG. 3 is a time chart for explaining operation performed when the control flowchart of FIG. 2 is carried out.

FIG. 3 is a time chart for explaining operation performed when the control flowchart is carried out.

To make it easier to recognize how the following description corresponds to the foregoing discussion of the flowchart, step numbers of the flowchart prefixed by the letter S are mentioned hereunder.

The engine controller operates in the below-described manner when the aforementioned control flowchart is executed.

When the cranking process is started at time tO (FIG. 3(F): step S1), the D-Jetronic system is initiated and the switching decision counter and the forced switching timer are cleared (FIGS. 3(A) and 3(G): step S2).

When the speed of the internal combustion engine becomes larger than the cranking speed at time t11 (FIG. 3(A): Yes in step S3), the change value Δ in the cylinder intake air quantity is calculated (FIG. 3(C): step S4). Meanwhile, the change value Δ in the cylinder intake air quantity indicated in FIG. 3(C) is a negative value before the same is converted into an absolute value, and the reference value is also indicated as a negative value.

When the cranking process is ended at time t12 (FIG. 3(F)), the forced switching timer begins to count up (FIG. 3(G)).

When the change value Δ in the cylinder intake air quantity becomes larger than the prescribed value (reference value) at time t13 (i.e., when the absolute value of the change value Δ becomes smaller than the reference value) (FIG. 3(C): Yes in step S5), the switching decision counter is caused to count up (FIG. 3(A): step S6). Steps S5, S6 and S7 are repetitively executed in this order until the count value of the switching decision counter becomes larger than the prescribed value (reference value).

The change value Δ in the cylinder intake air quantity is smaller than the reference value (i.e., the absolute value of the change value Δ is larger than the reference value) during a period from time t14 to time t15 (FIG. 3(C)). Thus, the switching decision counter stays standby and does not count up in step S5 (FIG. 3(A)).

The change value Δ in the cylinder intake air quantity becomes larger than the prescribed value (reference value) (i.e., the absolute value of the change value Δ becomes smaller than the reference value) at time t15 again (FIG. 3(C): Yes in step S5), causing the switching decision counter to count up (FIG. 3(A): step S6). Steps S5, S6 and S7 are repetitively executed until the count value of the switching decision counter becomes larger than the prescribed value (reference value).

The count value of the switching decision counter becomes larger than the prescribed value (reference value) at time t16 (FIG. 3(A): Yes in step S7) and, then, the internal combustion engine is switched from the D-Jetronic system to the L-Jetronic system (FIG. 3(A): step S8).

Figure 4:
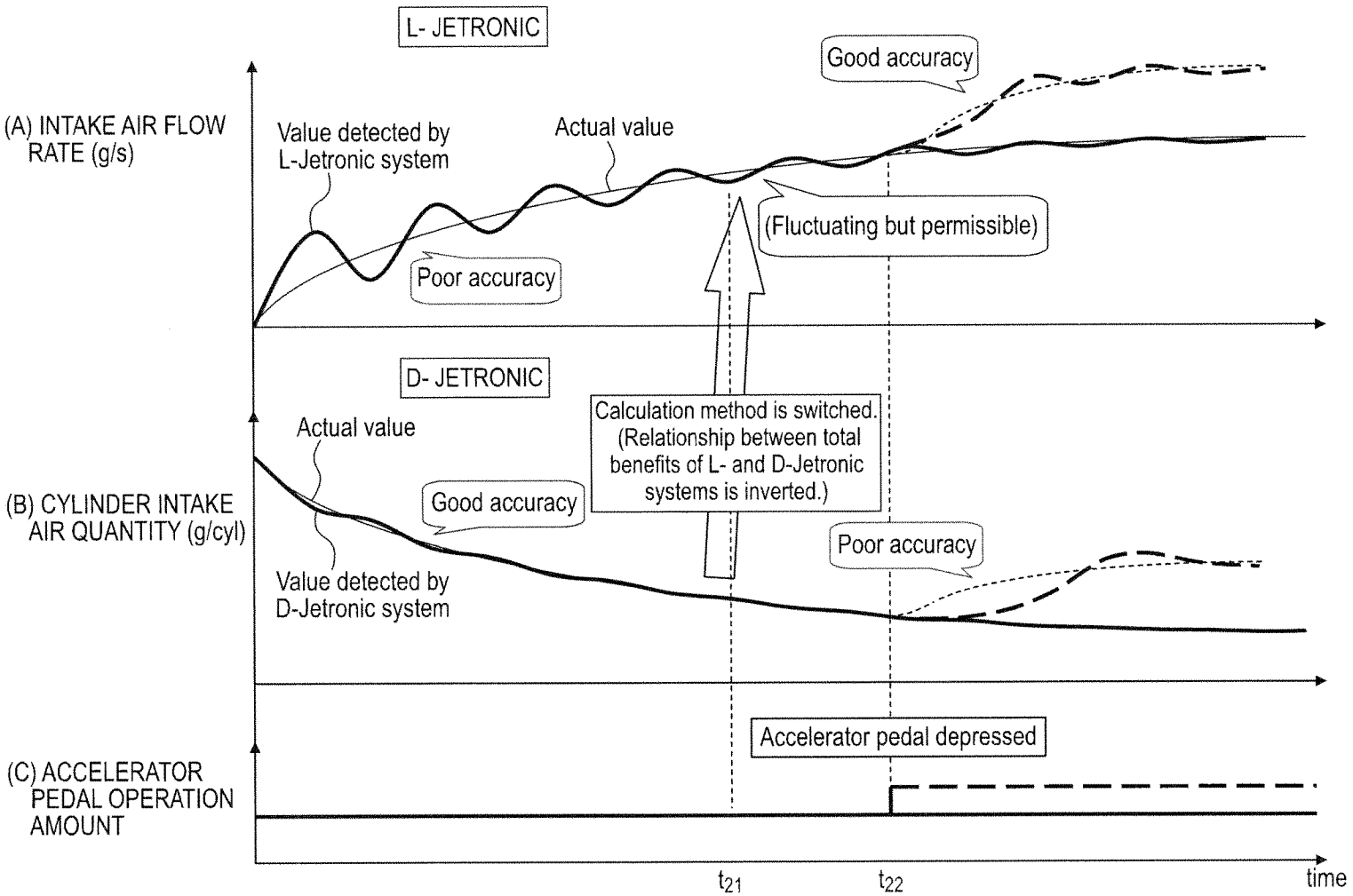
FIG. 4 is a diagram for explaining effects of the embodiment.

FIG. 4 is a diagram for explaining effects of the embodiment.

In this embodiment, the internal combustion engine is initially started in the D-Jetronic system and switched to the L-Jetronic system when the change value Δ in the cylinder intake air quantity (i.e., the absolute value of the difference between values obtained in a preceding cycle and a current cycle) becomes smaller than the prescribed value (reference value). Since this arrangement is employed, it is possible to detect the intake air flow rate with high accuracy. This feature is now described with reference to FIG. 4.

The intake air flow rate is low immediately after startup of the internal combustion engine. In this state, a value detected by the L-Jetronic system fluctuates and goes apart from the actual value as indicated in FIG. 4(A). In contrast, a value detected by the D-Jetronic system generally coincides with the actual value as indicated in FIG. 4(B). It is therefore preferable to detect by the D-Jetronic system immediately after startup of the internal combustion engine.

Considered next is a case where the intake air flow rate suddenly changes as a result of depression of an accelerator pedal after the intake air flow rate has increased to a certain extent. In this case, the value detected by the D-Jetronic system can not follow changes in the actual value and goes apart from the actual value as indicated in FIG. 4(B). By comparison, the value detected by the L-Jetronic system can follow changes in the actual value with high accuracy and generally coincides with the actual value as indicated in FIG. 4(A). It is therefore preferable to detect by the L-Jetronic system after the intake air flow rate has increased to a certain extent.

Thus, in the present embodiment, the internal combustion engine is switched to the L-Jetronic system when the change value Δ in the cylinder intake air quantity has become smaller than the prescribed value (reference value). Specifically, focusing in particular on the change value Δ in the cylinder intake air quantity, the internal combustion engine is switched from the D-Jetronic system to the L-Jetronic system when the change value Δ in the cylinder intake air quantity becomes closer to zero than to the reference value.

Although the L-Jetronic system provides quick response and serves to improve fuel economy and stabilize combustion during steady-state running conditions, the accuracy of detecting the intake air quantity decreases and the fuel injection quantity becomes unstable when the intake air flow rate is low.

Contrary to this, the D-Jetronic system gives slow response but can detect the cylinder intake air quantity (intake air flow rate) with higher accuracy than the L-Jetronic system when the intake air flow rate is low, so that the D-Jetronic system serves to relatively stabilize the fuel injection quantity (does not respond excessively).

Under such circumstances, the embodiment employs an arrangement to select the D-Jetronic system in the initial stage of cranking when the intake air flow rate is low and to switch the internal combustion engine to the L-Jetronic system when the intake air flow rate increases beyond a prescribed value.

Here, if the D-Jetronic system is selected when the intake air flow rate is low and the internal combustion engine is switched to the L-Jetronic system when the intake air flow rate has increased, it is impossible to set a fixed reference value for the intake air flow rate, because there occurs a change in operating conditions each time cranking is performed. It is also complex and difficult to set a plurality of reference values for varying operating conditions.

Therefore, if the method of calculating the fuel injection quantity is switched on the basis of the change value Δ in the cylinder intake air quantity as in the present embodiment, it is possible to determine that the intake air flow rate has stabilized with high accuracy and prevent a situation where the fuel injection quantity becomes unstable. It is also possible to prevent a situation where the L-Jetronic system which contributes to improving fuel economy and stabilizing combustion can not be used despite the fact that the intake air flow rate is already stabilized a latter half of the cranking process.

Also, it is not possible to make a decision on the basis of the speed of the internal combustion engine because the internal combustion engine is not necessarily correlated with the intake air flow rate or stability of the intake air flow rate. Nevertheless, if the decision is based on the change value Δ in the cylinder intake air quantity determined by the D-Jetronic system, it is possible to detect that the intake air flow rate has sufficiently increased and stabilized with high accuracy and swiftly switch the internal combustion engine to the L-Jetronic system.

Further, if the prescribed value (reference value) mentioned in step S7 of the embodiment is increased to a certain degree, it is possible to switch the internal combustion engine to the L-Jetronic system when a situation where the change value Δ in the cylinder intake air quantity is larger than the prescribed value (reference value) continues to exist for a prescribed time period. In the initial stage of cranking, there exists a situation where particularly significant variations occur in the change value Δ in the cylinder intake air quantity. Thus, there is a possibility that the intake air flow rate may not have sufficiently increased even if the change value Δ in the cylinder intake air quantity once becomes smaller than the prescribed value. If however, the internal combustion engine is switched to the L-Jetronic system when the situation where the change value Δ in the cylinder intake air quantity is smaller than the prescribed value (reference value) continues to exist for the prescribed time period as in the present embodiment, it is possible to detect that the intake air flow rate has sufficiently increased and stabilized with high accuracy.

Furthermore, in the present embodiment, the internal combustion engine is forcibly switched to the L-Jetronic system when a prescribed time period has elapsed after the cranking motor has been deactivated. This arrangement makes it possible to avoid a situation where the internal combustion engine is ceaselessly kept in the D-Jetronic system when the change value Δ in the cylinder intake air quantity does not converge.

This embodiment is not based on a technical idea of "using a value detected by the airflow meter which is not stabilized when the intake air quantity is small after the intake air quantity has become large enough to stabilize the value detected by the airflow meter." The embodiment is based on a technical idea of "giving priority to the fact that even if the value detected by the airflow meter more or less fluctuates, response characteristics in the event of a sudden change are improved by use of value detected by the airflow meter." Characteristic features and novelty of the invention exist in that, to implement the aforementioned technical idea, a decision on when the internal combustion engine should be switched during startup at which the intake air quantity sharply increases is made on the basis of the fact that the change in the actual cylinder intake air quantity has become small.

When the intake air flow rate is low prior to development of the negative pressure, the flow rate of air passing along a hot-wire portion of the airflow meter is too low so that the value detected by the airflow meter fluctuates despite the fact that the flow rate of air monotonically increases without fluctuating (rising and falling) in actuality. Therefore, even if the intake air quantity is calculated by the L-Jetronic system, a reduction in accuracy occurs as indicated during a period preceding time t21 in FIG. 4(A).

On the other hand, what is problematic when the intake air quantity increases, creating a situation where the value detected by the airflow meter is stabilized to a certain degree, is a delay in calculating the intake air quantity by the D-Jetronic system when a sudden change occurs in the actual intake air quantity as a result of depression of the accelerator pedal, for example, as indicated during a period following time t22 in FIG. 4(B). It is therefore preferable to select the L-Jetronic system after the intake air quantity has increased to a point where the value detected by the airflow meter is more or less stabilized.

In this embodiment, comparison is made between how low is the accuracy of calculating the intake air quantity by the L-Jetronic system caused by too low a intake air flow rate and how low is the accuracy of calculating the intake air quantity by the D-Jetronic system when the cylinder intake air quantity fluctuates, and the method of calculating the intake air quantity is switched during a process of negative pressure development, taking into consideration a timing at which total deterioration of fuel economy performance and exhaust performance is reduced as much as possible (or a timing at which a relationship between benefits of the L-Jetronic and D-Jetronic systems is inverted).

Basically, this timing may be a timing at which the intake air flow rate (cylinder intake air quantity) reaches a prescribed value.

It has however been found that this prescribed value of the intake air flow rate (cylinder intake air quantity) greatly fluctuates under the influence of operating conditions and environmental conditions so that it is extremely difficult to make corrections or perform adaptation (mapping) for the operating conditions and environmental conditions.

The result of investigation by the inventor has revealed that if the method of calculating the intake air quantity is switched when the change value Δ in the intake air flow rate (cylinder intake air quantity) has become equal to or larger than the prescribed value (equal to or smaller than the prescribed value in terms of the absolute value), intake air quantity calculation is not subjected to the influence of the operating conditions or environmental conditions, making it possible to set the timing of switching the method of intake air quantity calculation to the timing at which the relationship between benefits of the L-Jetronic and D-Jetronic operations is inverted with high accuracy in either case. Thus, the present invention employs an arrangement to switch the method of intake air quantity calculation on the grounds that the change value Δ in the intake air flow rate (cylinder intake air quantity) has become equal to or larger than the prescribed value (equal to or smaller than the prescribed value in terms of the absolute value). Specifically, the reference value of the change value Δ in the intake air quantity is defined as the change value Δ in the actual air quantity which indicates that the actual intake air quantity has reached an intake air quantity at which the fuel injection quantity calculated on the basis of the negative pressure of the intake air measured by the intake air pressure sensor gives a fuel injection quantity better corresponding to the actual intake air quantity than the fuel injection quantity calculated on the basis of the intake air flow rate measured by the airflow meter under steady-state conditions where the accelerator pedal operation amount does not change and at which the fuel injection quantity calculated on the basis of the intake air flow rate measured by the airflow meter gives a fuel injection quantity better corresponding to the actual intake air quantity than the fuel injection quantity calculated on the basis of the negative pressure of the intake air measured by the intake air pressure sensor under transient conditions where the accelerator pedal operation amount changes." With this arrangement, it has become possible to switch the method of intake air quantity calculation while maintaining a high detection accuracy without being affected by the operating (environmental) conditions. Although the value detected by the airflow meter shows high follow-up tendency at the timing of switching the method of intake air quantity calculation, the detected value can still fluctuate. Thus, the embodiment employs an arrangement to obtain the change value Δ, regarding the value detected by the intake air pressure sensor which give a stable value as the actual value of the intake air flow rate (cylinder intake air quantity). Alternatively, it is possible to employ an arrangement to use the value detected by the intake air pressure sensor itself (intake air pressure) and compare the detected value with a reference value which is set correspondingly to the intake air pressure. Specifically, it is possible to employ various kinds of parameters derived on the basis of the negative pressure of the intake air measured by the intake air pressure sensor as the actual intake air quantity.

Incidentally, the technical idea of this embodiment is not directed to using the value detected by the airflow meter after the value detected by the airflow meter has ceased to fluctuate. The embodiment is intended to switch to the method of calculation using the value detected by the airflow meter on the grounds that the change value Δ of an actual value which monotonically increases or decreases (i.e., the value which can be detected by the intake air pressure sensor), and not the fluctuation which occurs just because the airflow meter has detected the value, has become equal to or smaller than the prescribed value. The embodiment is not intended to employ the technical idea of using the value detected by the airflow meter after the value detected by the airflow meter has ceased to fluctuate.

As thus far described, it is possible to inject the fuel in a stable fashion even when the intake air flow rate is low, such as during cranking, and to switch the accuracy of intake air flow rate detection under conditions where the accuracy is high according to the embodiment.

Meanwhile, the intake air flow rate remains unstable especially when an intake throttle is closed during cranking to develop a negative pressure on a downstream side along an intake air flow direction of the intake throttle. The present embodiment is particularly effective in such cases. Even when no special control operation is performed concerning the opening of the intake throttle during the cranking process, however, the embodiment is effective because the intake air flow rate is not stabilized during the cranking process or in an early stage after startup of the internal combustion engine.

While the embodiment of the present invention has thus far been described, the foregoing embodiment has portrayed simply an illustrative example of the invention and is not meant to limit the technical scope of the invention to the specific configuration described heretofore.

The present application claims priority to Japanese Patent Application No. 2010-290239 filed in Japan Patent Office on Dec. 27, 2010. The contents of this application are incorporated herein by reference in their entirety.

The invention claimed is:

1. A control device for an internal combustion engine provided with an intake air pressure sensor and an airflow meter, the control device comprising:

a calculation unit for calculating a fuel injection quantity on the basis of a negative pressure of intake air measured by the intake air pressure sensor when a cranking motor starts cranking the internal combustion engine; and a switching unit for switching to calculation of the fuel injection quantity on the basis of an intake air flow rate measured by the airflow meter when, during a process of negative pressure development in an intake passage after the cranking motor starts cranking, a change value in an actual intake air quantity, derived on the basis of the negative pressure of intake air measured by the intake air pressure sensor, becomes smaller than a reference value;

wherein the switching unit maintains the calculation of the fuel injection quantity on the basis of the intake air flow rate in response to a depression of an accelerator pedal that causes transition to transient conditions immediately after the switching to calculation of the fuel injection quantity on the basis of the intake air flow rate measured by the airflow meter, wherein the reference value is the change value in an actual air quantity which indicates that the actual intake air quantity has reached an intake air quantity at which the fuel injection quantity calculated on the basis of the negative pressure of the intake air measured by the intake air pressure sensor gives a fuel injection quantity that better corresponds to the actual intake air quantity than the fuel injection quantity calculated on the basis of the intake air flow rate measured by the airflow meter under steady-state conditions, where an accelerator pedal stroke does not change, and at which the fuel injection quantity calculated on the basis of the intake air flow rate measured by the airflow meter gives a fuel injection quantity that better corresponds to the actual intake air quantity than the fuel injection quantity calculated on the basis of the negative pressure of the intake air measured by the intake air pressure sensor under transient conditions where the accelerator pedal stroke changes, and wherein the control device is configured to control a fuel injector to inject the fuel injection quantity calculated on the basis of the negative pressure of intake air or calculated on the basis of the intake air flow rate.

2. The control device for the internal combustion engine according to claim 1, wherein:

the switching unit switches to the calculation on the basis of the intake air flow rate measured by the airflow meter when a situation where the change value in the actual intake air quantity is smaller than the reference value continues to exist for a prescribed time period.

3. The control device for the internal combustion engine according to claim 1, wherein:

the switching unit switches the calculation unit so as to calculate the fuel injection quantity on the basis of the intake air flow rate measured by the airflow meter if the fuel injection quantity is calculated on the basis of the negative pressure of the intake air even when a prescribed time period elapses after the cranking motor has stopped cranking.

4. The control device for the internal combustion engine according to claim 1, wherein:

the control device is configured to determine whether a speed of the internal combustion engine is larger than a speed of the cranking motor and switches to calculation of the fuel injection quantity on the basis of the intake air flow rate measured by the airflow meter when the change value in the actual intake air quantity becomes smaller than the reference value after the engine speed has exceeded an engine speed below which the change value in the intake air quantity does not become smaller than the reference value for a prescribed time period.

5. The control device for the internal combustion engine according to claim 1, wherein:

the switching unit switches to calculation of the fuel injection quantity on the basis of the intake air flow rate measured by the airflow meter when the change value in the actual intake air quantity becomes smaller than a single reference value.

6. The control device for the internal combustion engine according to claim 1, further comprising:

a counter configured to count up when the change value in the actual intake air quantity becomes smaller than a reference value, wherein the switching unit switches to the calculation on the basis of the intake air flow rate measured by the airflow meter when a situation where the change value in the actual intake air quantity is smaller than the reference value continues to exist for a prescribed time period as measured by a count value of the counter exceeding a prescribed count value.

* * * * *